US005784911A

United States Patent [19]

Hashimoto et al.

[11] Patent Number: 5,784,911

[45] Date of Patent: *Jul. 28, 1998

[54] APPARATUS FOR MANUFACTURING A WELDED PIPE

[75] Inventors: Yuji Hashimoto; Takaaki Toyooka; Motoaki Itatani; Susumu Itatani; Tsutomu Ide, all of Chiba, Japan

[73] Assignees: Kusakabe Electric & Machinery Co., Ltd.; Kawasaki Steel Corporation, both of Hyogo-Ken, Japan

[ * ] Notice: The portion of the term of this patent subsequent to Jun. 10, 2016, has been disclaimed.

[21] Appl. No.: 803,923

[22] Filed: Feb. 21, 1997

Related U.S. Application Data

[63] Continuation of Ser. No. 386,362, Feb. 9, 1995, abandoned.

[51] Int. Cl.[6] ..... B21D 39/02; B21D 5/08; B21D 51/28

[52] U.S. Cl. ..... 72/52; 72/178; 72/176

[58] Field of Search ..... 29/890.053, 33 D; 72/51, 52, 177, 178, 179, 181, 182; 228/147

[56] References Cited

U.S. PATENT DOCUMENTS

| | | | |
|---|---|---|---|
| 1,163,975 | 12/1915 | Cromwell | 72/100 |
| 3,145,758 | 8/1964 | Sprung et al. | 72/190 |
| 3,204,847 | 9/1965 | Vitense | 413/69 |
| 4,299,108 | 11/1981 | Kato et al. | 72/181 |
| 4,947,671 | 8/1990 | Lindström | 72/52 |

FOREIGN PATENT DOCUMENTS

| | | | |
|---|---|---|---|
| 59-202122 | 11/1984 | Japan . | |
| 60-174216 | 9/1985 | Japan . | |
| 62-158528 | 7/1987 | Japan . | |
| 0044217 | 2/1989 | Japan | 72/178 |
| 0197329 | 8/1990 | Japan | 72/178 |
| 3-174922 | 7/1991 | Japan . | |

*Primary Examiner*—Lowell A. Larson
*Assistant Examiner*—Rodney A. Butler
*Attorney, Agent, or Firm*—Sterne, Kessler, Goldstein & Fox P.L.L.C.

[57] ABSTRACT

An apparatus for manufacturing a welded pipe. The apparatus includes a cage or cluster roller molding system. In either case, a rotary axis of each roller is slanted counter-clockwise or clockwise with respect to a manufacturing line direction of the apparatus. The adjustable positioning of the rotary axis reduces vertical slip caused when the strip of material passes along the contact surface of the roller.

14 Claims, 10 Drawing Sheets

APPARATUS FOR MANUFACTURING A WELDED PIPE

This application is a continuation of application Ser. No. 08/386,362, filed Feb. 9, 1995, now abandoned.

BACKGROUND OF THE INVENTION

1. Field of the Invention

The present invention relates to an apparatus for manufacturing a welded pipe.

2. Related Art

A conventional molding unit for a welded pipe is shown in FIGS. 4 and 5. This molding unit manufactures a line of welded pipe using a cage roller molding system. In the drawings, reference numeral 1 designates a strip of base pipe material undergoing the molding process. The cage roller molding system comprises a plurality of inner rollers 101, whose roller width sequentially decreases from the upstream side of the unit to the downstream side. The molding unit also has a plurality of cage rollers 102 disposed on both sides of inner rollers 101. Cage rollers 102 are adjusted in their vertical alignment and width to achieve the desired molding characteristics. Inner rollers 101 and cage rollers 102 apply bending forces to the center and edges of a strip of pipe material to gradually bend the strip into a U shape and then into a cylinder.

A conventional molding unit using cluster rollers to form the welded pipe is shown in FIGS. 12 and 13. This molding unit uses breakdown rollers, composed of pairs of upper and lower breakdown rollers, and cluster rollers, composed of pairs of left and right cluster rollers, in several stages, respectively. A strip of pipe material is gradually bent in a cylinder by these rollers. The cluster rollers are disposed such that the curve of the cluster rollers is an involute of the curve of the base pipe. That is, the tangents of the curve of the base pipe are normals to the curve of the cluster rollers. This type of unit is disclosed in, for example, Japanese Patent Laid-Open Gazette No. Sho 62-158528.

Conventional cage rollers 102, each having a convex surface, are shown in FIG. 6. This type of cage roller is disclosed in, for example, Japanese Patent Laid-Open Gazette No. Sho 59-202122.

A second type of conventional cage rollers 102, each having a flat surface, are shown in FIG. 7. This type of cage roller is disclosed in, for example, Japanese Patent Laid-Open Gazette No. Sho 60-174216.

A third type of conventional cage roller 102, having concave surfaces are shown in FIG. 8, and are disclosed in, for example, Japanese Patent Laid-Open Gazette No. Hei 3-174922.

All of the above-mentioned conventional cage rollers are suitable for manufacturing various sizes of pipe.

When cage rollers having convex or flat surfaces at the roller surface are used in the molding process, the part of the molded pipe in contact with the roller surface becomes flat. Thus, these cage rollers decrease the roundness and quality of the pipe. When cage rollers 102 having a concave surface are used, the pipe is prevented from being flattened, thus improving the roundness of the molded pipe. However, in a case where the pipe is formed of a steel, such as stainless steel, seizure of the pipe by the roller often occurs. Because the surface condition of the steel must be a mirror finish, roll marks from the seizure are easily conveyed to the pipe surface, thus causing a decrease in the quality of the pipe.

When lubrication is applied to the roller with soluble oil or the like, the occurrence of seizure of the roller is eliminated, and thus the problem of roll marks is obviated. However, the application of a lubricant to the rollers is not preferable for weld-difficult materials, such as stainless steel. The lubricant causes welding to become unstable and, as a result, the strength of the welded portion will deteriorate.

Even when cluster rollers are used, if the pipe is formed from stainless steel or the like, roll marks are liable to be produced. Also, the conventional cage roller molding system and the molding system using cluster rollers are both defective in that the strip undergoing the molding process is liable to roll circumferentially.

SUMMARY OF THE INVENTION

An object of the present invention is to provide an apparatus for manufacturing welded pipe in which the molding process is stabilized and in which superior appearance, overall quality and weld quality are ensured. The present invention provides an apparatus for manufacturing a welded pipe using a cage roller molding system or an arrangement of cluster rollers. The axis of a rotary shaft of the cage roller or the cluster roller is slanted with respect to the manufacturing line in the counterclockwise or clockwise direction to reduce vertical slip generated when a strip of pipe material passes through a contact surface thereof with the surface of the cage roller or cluster roller.

These and other objects of the invention will become more apparent in the detailed description and examples which follow.

BRIEF DESCRIPTION OF THE FIGURES

The accompanying drawings, which are incorporated in and form a part of the specification, illustrate different embodiments of the present invention and, together with the description, serve to explain the principles of the invention. In the drawings.

DETAILED DESCRIPTION OF THE DRAWINGS

A preferred embodiment of the present invention is now described with reference to the figures. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant art that this invention can also be employed in a variety of other devices and applications.

Figure 3:
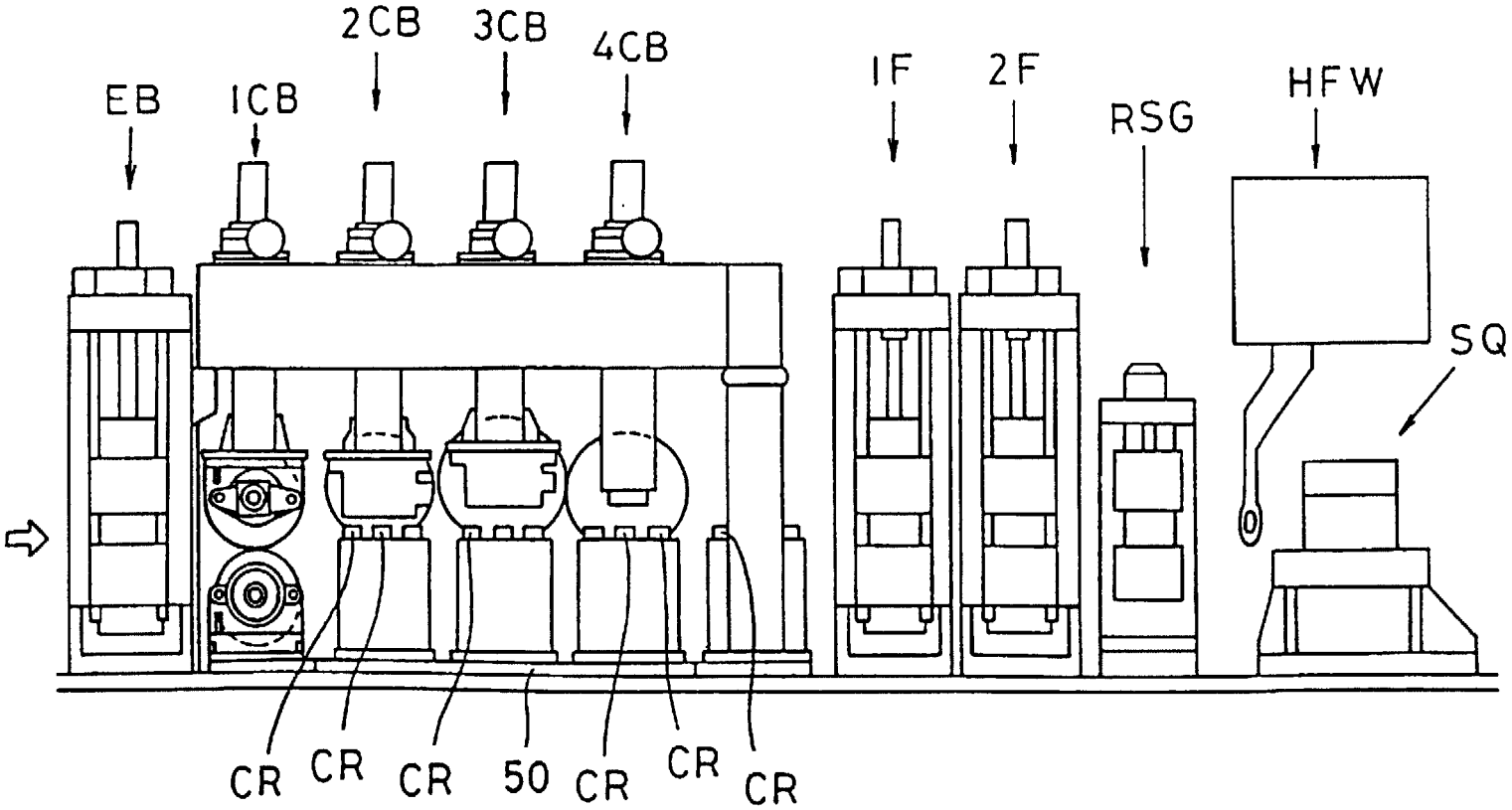
FIG. 3 shows an example of a welded pipe manufacturing system in which the present invention can be used.
Figure 4:
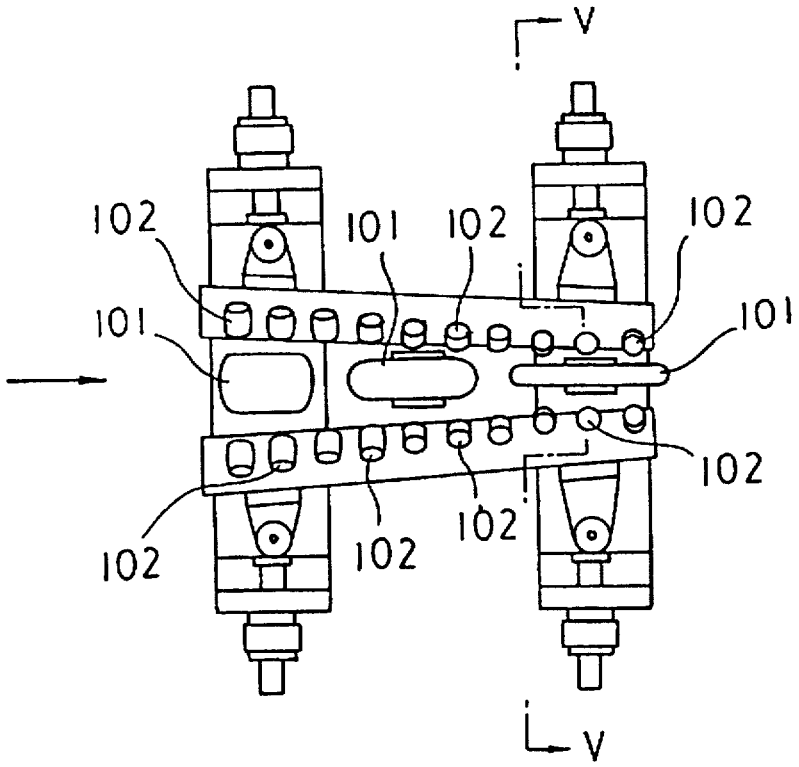
FIG. 4 is a plan view of a conventional welded pipe manufacturing system.
Figure 5:
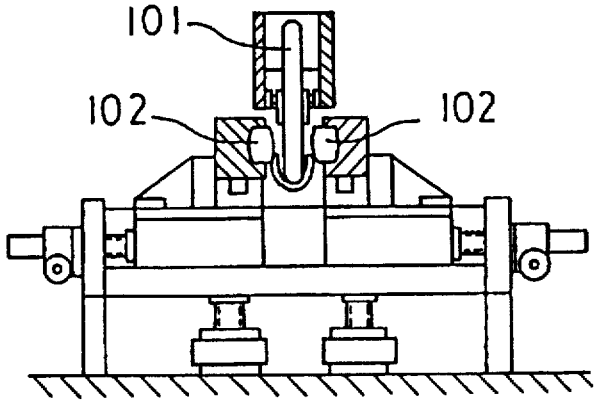
FIG. 5 is a sectional view of the conventional welded pipe manufacturing system taken along line V—V in FIG. 4.
Figure 6:
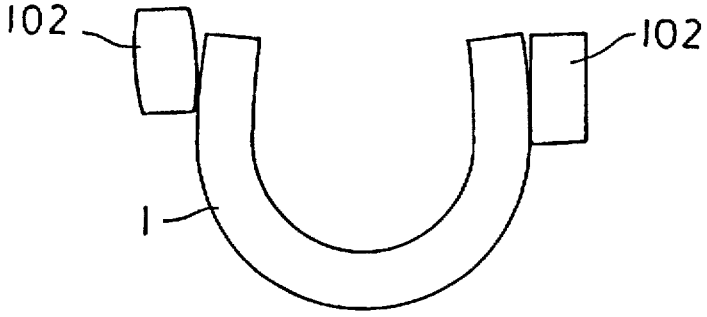
FIG. 6 shows a strip of pipe material being molded by cage rollers having a convex surface.
Figure 7:
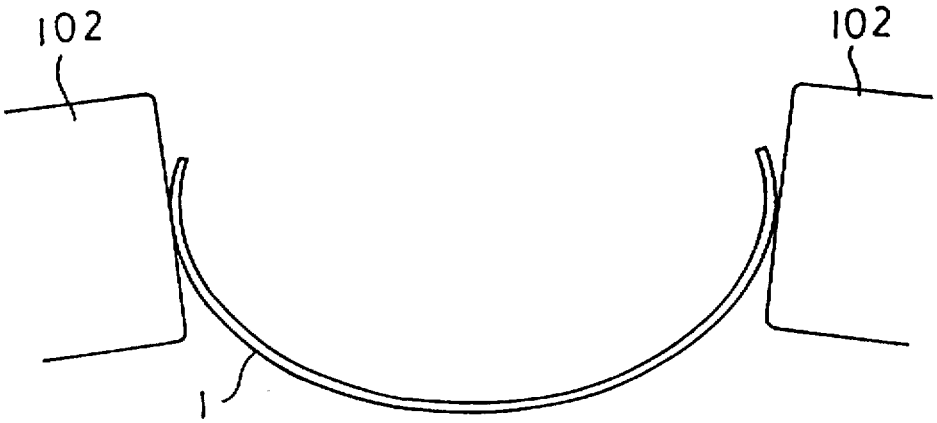
FIG. 7 shows the strip of pipe material being molded by cage rollers having a flat surface.
Figure 8:
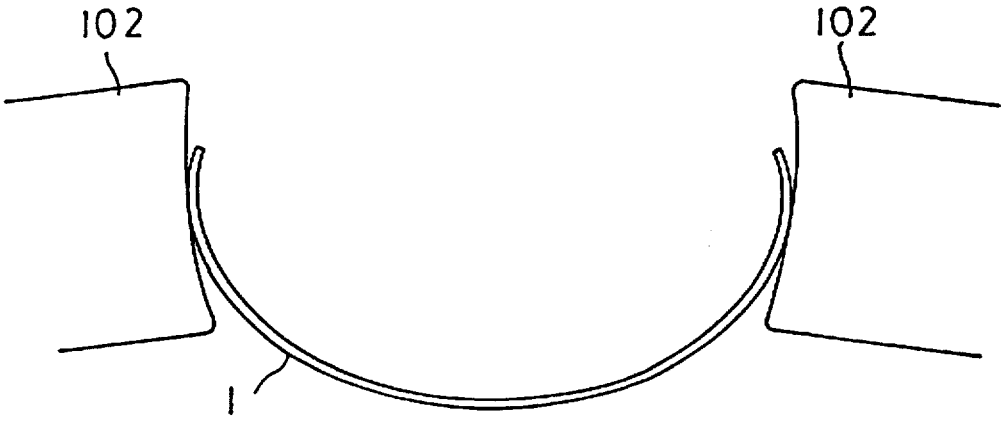
FIG. 8 shows the strip of pipe material being molded by cage rollers having a concave surface.

FIG. 3 shows one embodiment of a welded pipe manufacturing system of the present invention, comprising an edge bend roller EB; a first center bend roller 1CB; second, third and fourth center bend rollers 2CB, 3CB and 4CB, respectively; a plurality of cage rollers CR; a first and second fin pass roller 1F and 2F, respectively; a rotary seam guide roller RSG; a high frequency welder HFW; and a squeeze roller SQ; sequentially disposed from the upstream side to the downstream side of the welded pipe manufacturing system.

Among the above rollers, edge bend roller EB; first center bend roller 1CB; second, third and fourth center bend rollers 2CB, 3CB and 4CB; first and second fin pass rollers 1F and 2F; and rotary seam guide roller RSG are each disposed in pairs of an upper roller and a lower roller. Cage rollers CR and squeeze roller SQ are each disposed in pairs of a left roller and a right roller.

Edge bend roller EB bends the edges of a strip of base pipe (not shown). First center bend roller 1CB slightly bends both sides of the strip of base pipe. Second, third and fourth center bend rollers 2CB, 3CB and 4CB press down and bind up a portion of the strip of base pipe material from a boundary between both sides of the strip and the bottom of the base pipe to the bottom of the base pipe. Cage rollers CR apply lateral pressure to each side of the edge of the base pipe through both sides thereof, thereby molding the strip into a base pipe, having an oval-shaped cross-section (not shown) wherein the edges of the strip form a seam (not shown).

Next, first and second fin pass rollers 1F and 2F extend to both the sides and the edges of the base pipe and use pressure to mold the base pipe. Thus, the base pipe is bent so that the cross-section is substantially cylindrical. Rotary seam guide roller RSG rotates the base pipe to align the seam with the high frequency welder HFW. High frequency welder HFW then distributes a welding current into the seam causing it to be heated and melted. Squeeze roller SQ joins the seam.

Figure 1:
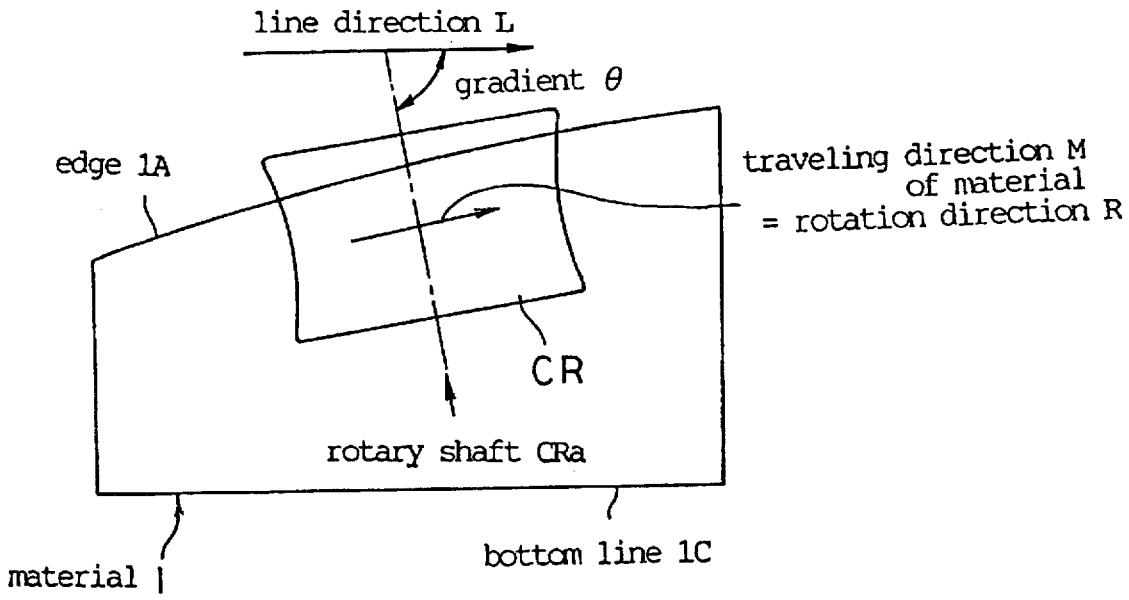
FIG. 1 shows a cage roller or a cluster roller slanted counterclockwise to the manufacturing apparatus according to the present invention.
Figure 2:
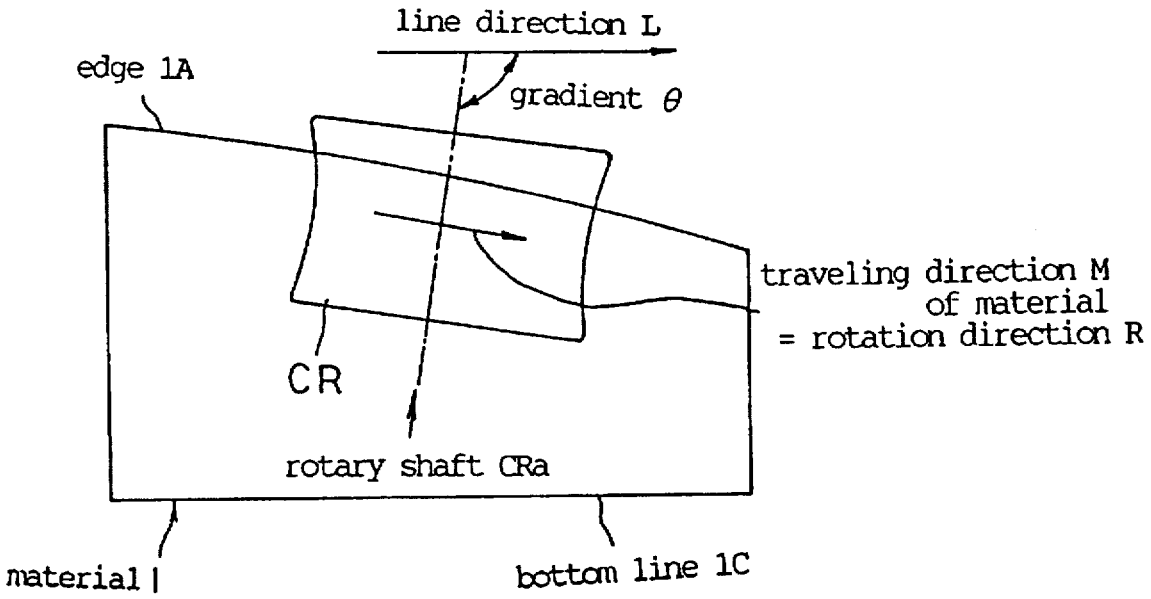
FIG. 2 shows the cage roller or the cluster roller slanted clockwise to the manufacturing apparatus according to the present invention.

Twelve cage rollers CR are disposed on either side of the base pipe. As shown in FIGS. 1 and 2, each cage roller has a rotary axis CRa. Each rotary axis CRa is adjustable by rotating cage roller CR counterclockwise or clockwise about the plane containing rotary axis CRa, such that the angle θ, formed between rotary axis CRa and the direction of the manufacturing line L, increases or decreases, respectively. A horizontal plane of manufacturing line direction L (not shown) includes manuifacturing line L and extends into page containing FIG. 1.

The traveling direction M of material to be manufactured at the contact portion of a cage roller CR and the outer diameter of the base pipe is illustrated in FIG. 1. Traveling direction M and the rotation direction R of rotary axis CRa are substantially coincident with each other. Thus, each cage roller CR is rotated so as to reduce the vertical slip generated when the strip to be manufactured passes along the contact surface of each cage roller CR. In addition, advance and retreat means (not shown) and vertical adjusting means (not shown) for cage roller CR is provided to accommodate base pipes of varying outer diameter size.

The embodiment described above and shown in FIGS. 1 and 2 manufactures a pipe of 22.22 to 60.5 mm in outer diameter without use of lubrication from a stainless steel strip of 0.8 to 3.0 mm in thickness. Roll marks generally caused by a cage roller CR seizure are not produced using this embodiment.

Figure 9:
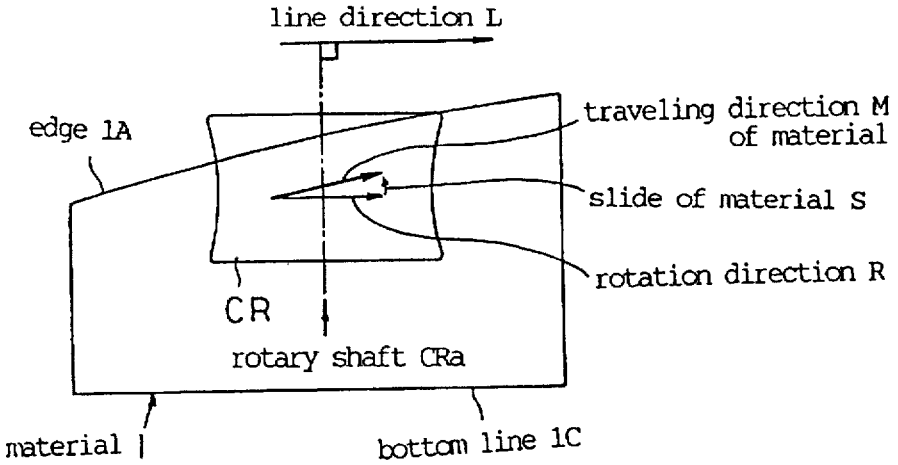
FIG. 9 shows the position of the cage roller or cluster roller of a conventional welded pipe manufacturing system.
Figure 10:
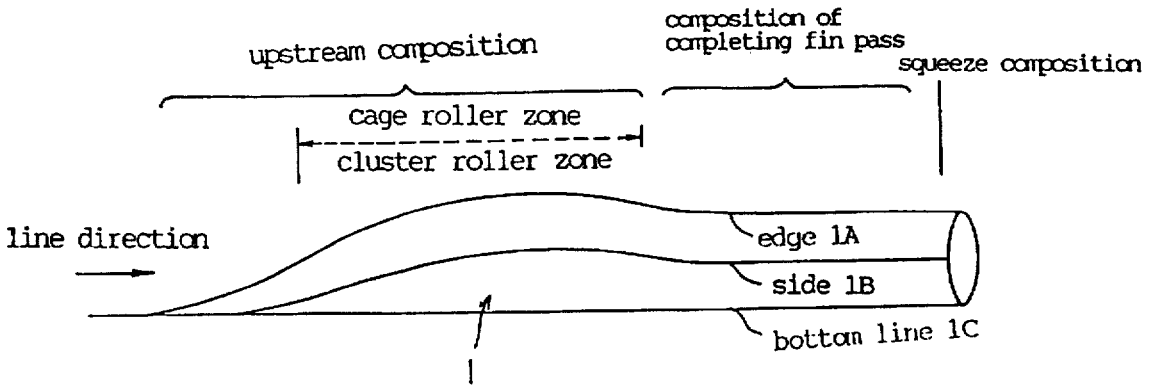
FIG. 10 is a diagram showing an example of the transition of a point in the circumferential direction of a base pipe during the molding process.

FIG. 10 is a diagram showing the change in height of a point circumferentially on base pipe 1 while base pipe 1 is undergoing the molding process. Two points, for example, are shown in FIG. 10 as an edge 1A and a side 1B of the base pipe. In addition, FIG. 10 shows that a bottom line 1C of the base pipe maintains a constant height. Further, FIG. 10 denotes where the upstream composition area and cage rollers or cluster rollers CR are disposed. The height of edge 1A and side 1B increase in the upstream composition area from the upstream side to the medium side of the manufacturing line. The height of edge 1A and side 1B each peak at the medium side and decrease at a downstream side of the manufacturing line. On the contrary, as shown in FIG. 9, rotary axis CRa of a conventional cage roller or cluster roller CR is set perpendicularly to manufacturing line direction L. Thus, in the conventional system, rotation direction R of cage roller or cluster roller CR is always parallel to line direction L and is inclined from the traveling direction M of the material at the contact portion thereof with cage roller CR.

Accordingly, when the strip comes in contact with the cage rollers or cluster rollers CR, the strip slips vertically on the surface of the rollers and a frictional force is generated vertically between the cage roller or cluster roller CR and the strip. When steel, such as stainless steel, is used for the strip material, seizure of the strip by the cage roller CR frequently occurs. Without lubrication on cage roller CR, the vertical frictional force of cage roller CR against the strip increase causing roll marks in the strip. Also, the vertical frictional force vertically pushes the strip, whereby, when the left and right rollers of the cage rollers or cluster rollers CR are unbalanced due to a camber or the like of the strip, the vertical frictional force will cause the strip to roll.

In the present invention, as shown in FIG. 1, the plane of rotary axis CRa of the rollers is slanted counterclockwise with respect to manufacturing line direction L, or clockwise, as shown in FIG. 2. Thus, the traveling direction M of the strip and the rotation direction R of the roller CR are substantially coincident with each other. Therefore, the vertical frictional force generated between cage roller or cluster roller CR and the strip are significantly decreased. Thus, even when stainless steel material or the like is used to form a pipe without lubrication of roller CR, no roll mark is formed, and no rolling of the strip occurs.

Figure 11:
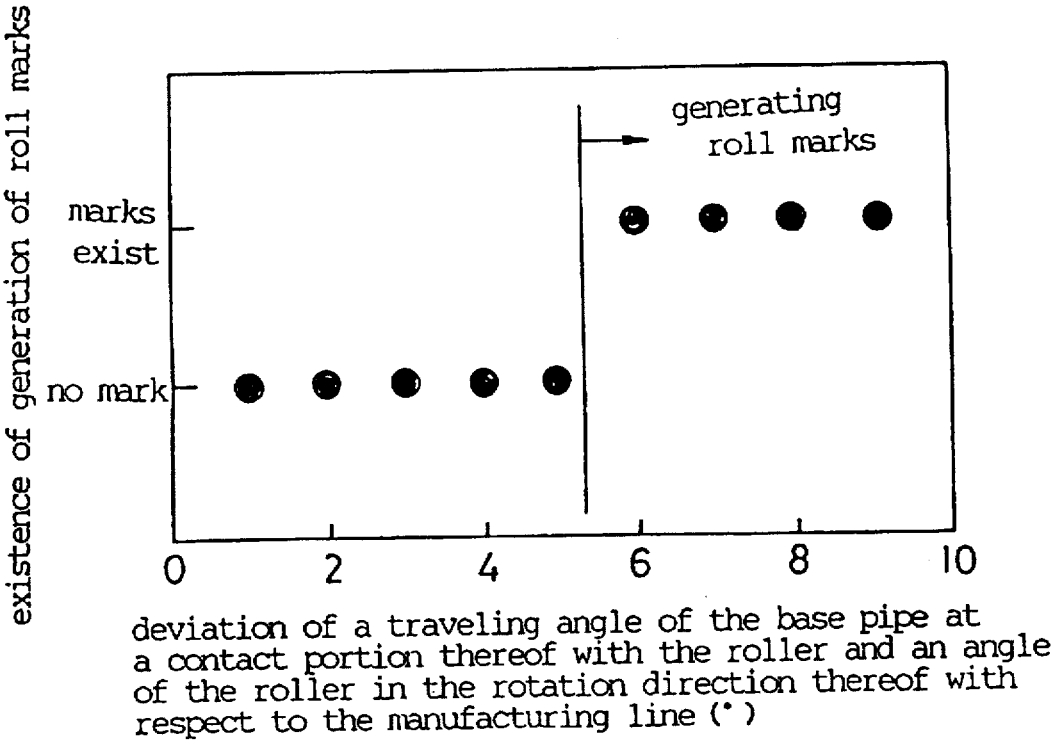
FIG. 11 is a graph showing the relationship between the frequency of roll marks and the deviation of the traveling angle of the base pipe at a contact portion thereof with the roller and an angle of the roller in the rotation direction thereof with respect to the manufacturing line.
Figure 12:
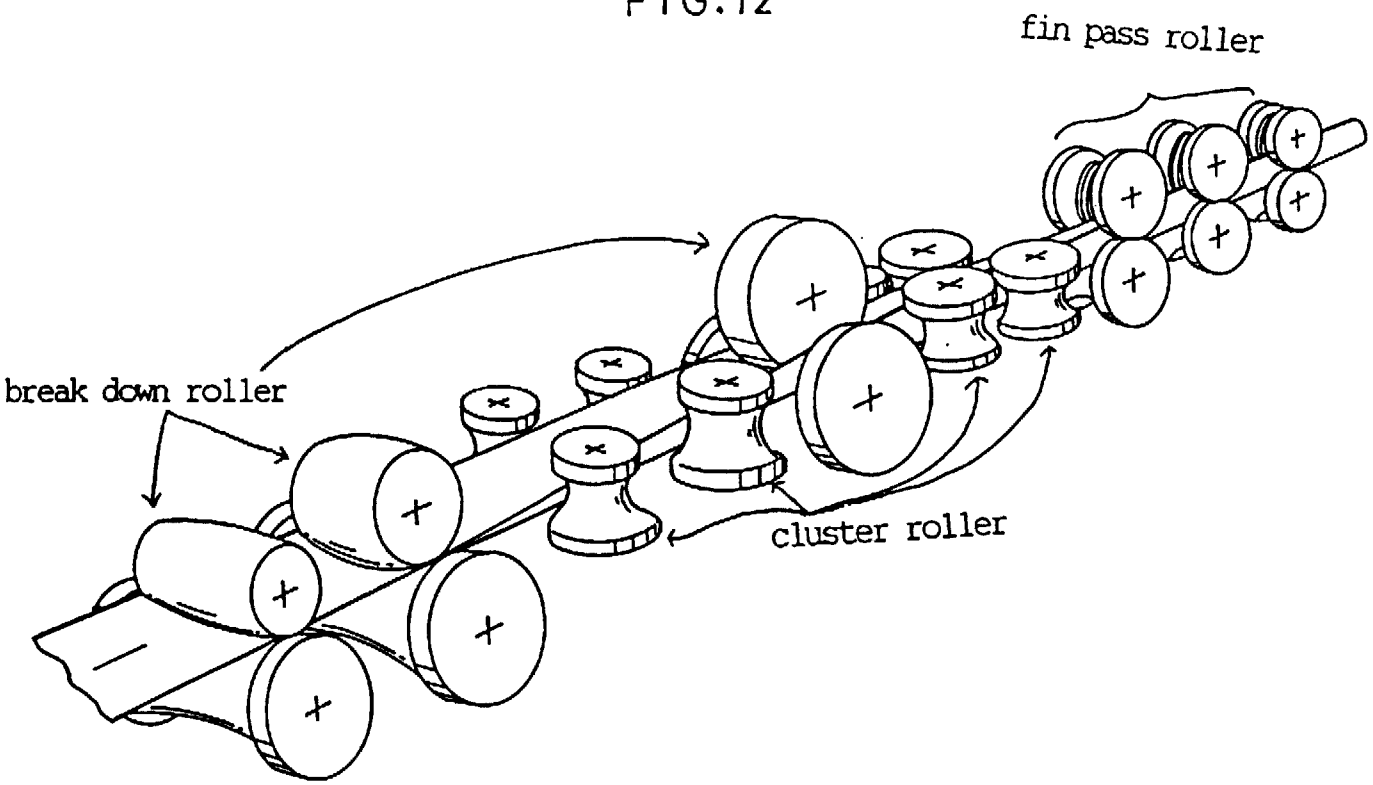
FIG. 12 is a plan view of a conventional welded pipe manufacturing system.
Figure 13:
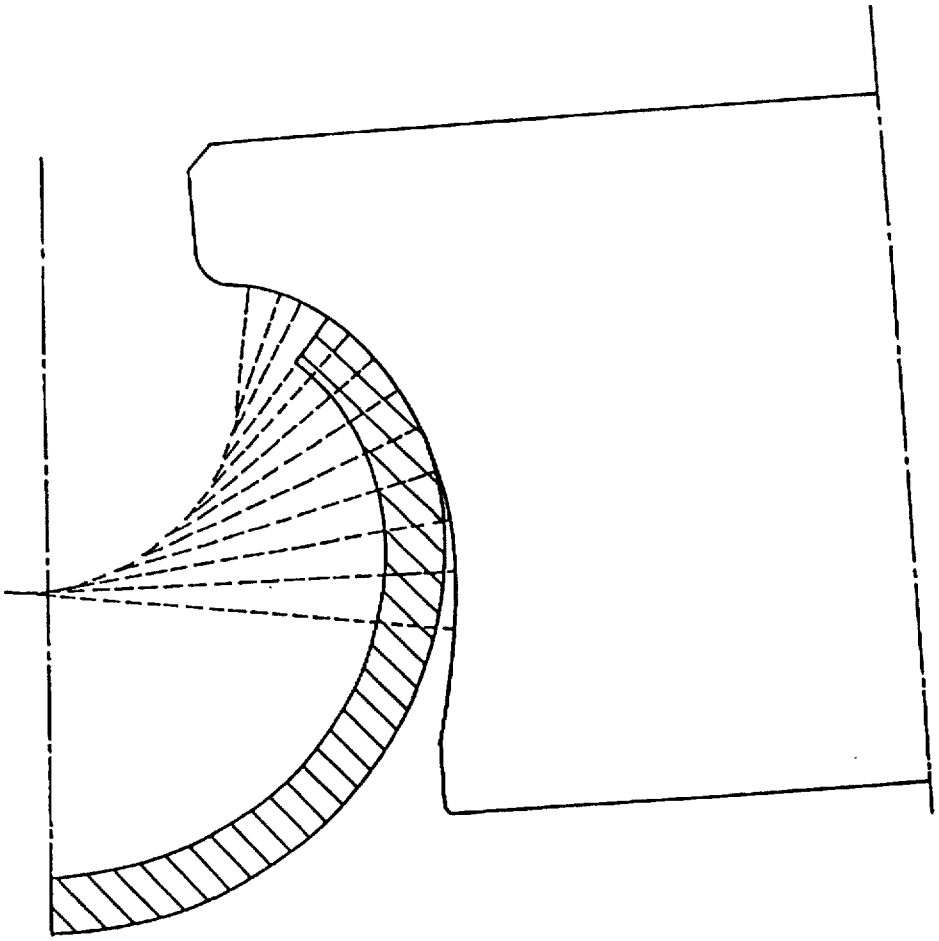
FIG. 13 shows a strip of pipe material being molded by a cluster roller having a roller surface in an involute curve.

FIG. 11 is a graph showing the relationship between the frequency of roll marks and the deviation of the traveling angle of material to an angle of rotation direction at the contact portion of the material with the roller and the manufacturing line direction. As shown in FIG. 11, when the deviation exceeds 5.0°, a roll mark is produced. Thus, it is preferable that the axis of rotary axis CRa of cage roller or cluster roller CR is slanted at an angle of 5.0° or less from manufacturing line direction L. The present invention slants the axis of the rotary shaft CRa of the cage roller or cluster roller CR counterclockwise or clockwise to the manufacturing line direction L, so that the vertical frictional force at the contact portion of the cage roller or cluster roller CR and the strip is significantly decreased. Thus, the present invention produces a welded pipe with a clean appearance having an improved quality with no roll marks produced on its surface.

While a preferred embodiment of the invention has been described using specific terms, such description is for illustrative purposes only, and it is to be understood that changes and variations may be made without departing from the spirit or scope of the following claims.

What is claimed is:

1. An apparatus for manufacturing a welded pipe, wherein the apparatus comprises:

a first roller disposed in an upstream composition area of a horizontal manufacturing line of said apparatus, said first roller having a first rotary axis which is substantially vertical with respect to said horizontal manufacturing line, wherein said first rotary axis is slanted in a direction with respect to said horizontal manufacturing line, whereby one end of said first rotary axis is closer to a beginning of said horizontal manufacturing line than another end of said first rotary axis; and a second roller disposed opposite to said first roller in said upstream composition area of said horizontal manufacturing line, wherein said second roller has a second rotary axis which is substantially vertical with respect to said horizontal manufacturing line, wherein said second rotary axis is slanted in a direction with respect to said horizontal manufacturing line, whereby one end of said second rotary axis is closer to a beginning of said horizontal manufacturing line than another end of said second rotary axis, wherein said first rotary axis and said second rotary axis are slanted to extend in the same direction, such that said first rotary axis and said second rotary axis are substantially parallel to each other to form a plane, said plane disposed at an angle to said horizontal manufacturing line and wherein vertical slip caused when a strip of pipe material contacts a surface of each of said first and second rollers is reduced.

2. The apparatus of claim 1, wherein the direction in which said first and second rollers are slanted is counterclockwise.

3. The apparatus of claim 1, wherein the direction in which said first and second rollers are slanted is clockwise.

4. The apparatus of claim 1, wherein said first and second rollers comprise a plurality of first and second rollers.

5. The apparatus of claim 4, wherein said first roller and said second roller are cage rollers.

6. The apparatus in claim 4, wherein said first roller and said second roller are cluster rollers.

7. The apparatus of claim 4, wherein said first roller and said second roller are outer rollers.

8. An apparatus for manufacturing a welded pipe, wherein the apparatus comprises:

a first roller disposed in an upstream composition area of a horizontal manufacturing line of said apparatus, said first roller having a first rotary axis which is substantially vertical with respect to said horizontal manufacturing line, wherein said first rotary axis is slanted in a direction with respect to said horizontal manufacturing line, whereby one end of said first rotary axis is closer to a beginning of said horizontal manufacturing line than another end of said first rotary axis; and a second roller disposed opposite to said first roller in said upstream composition area of said horizontal manufacturing line, wherein said second roller has a second rotary axis which is substantially vertical with respect to said horizontal manufacturing line, wherein said second rotary axis is slanted in a direction with respect to said horizontal manufacturing line, whereby one end of said second rotary axis is closer to a beginning of said horizontal manufacturing line than another end of said second rotary axis, wherein said first rotary axis and said second rotary axis are slanted to extend in the same direction, such that said first rotary axis and said second rotary axis are substantially parallel to each other to form a plane, said plane disposed at an angle to said horizontal manufacturing line, wherein said first and second rollers each have a rotation direction which is substantially coincident with a traveling direction of a strip of pipe material at a contact surface of each of said first and second rollers with said strip of pipe material, and wherein vertical slip caused when a strip of pipe material contacts a surface of each of said first and second rollers is reduced.

9. The apparatus of claim 8, wherein the direction in which said first and second rollers are slanted is counterclockwise.

10. The apparatus of claim 8, wherein the direction in which said first and second rollers are slanted is clockwise.

11. The apparatus of claim 8, wherein said first and second rollers comprise a plurality of first and second rollers.

12. The apparatus of claim 11, wherein said first roller and said second roller are cage rollers.

13. The apparatus of claim 11, wherein said first roller and said second roller are cluster rollers.

14. The apparatus of claim 11, wherein said first roller and said second roller are outer rollers.

* * * * *